US011658437B2

(12) United States Patent
Schönfeld

(10) Patent No.: US 11,658,437 B2
(45) Date of Patent: May 23, 2023

(54) HOLDING FRAME COMPRISING A FIXING ELEMENT HELD IN A MOVABLE MANNER

(71) Applicant: HARTING Electric GmbH & Co. KG, Espelkamp (DE)

(72) Inventor: Alexander Schönfeld, Osnabruck (DE)

(73) Assignee: HARTING ELECTRIC GMBH & CO. KG, Espelkamp (DE)

( * ) Notice: Subject to any disclaimer, the term of this patent is extended or adjusted under 35 U.S.C. 154(b) by 423 days.

(21) Appl. No.: 15/756,262

(22) PCT Filed: Aug. 19, 2016

(86) PCT No.: PCT/DE2016/100378
§ 371 (c)(1),
(2) Date: Feb. 28, 2018

(87) PCT Pub. No.: WO2017/036451
PCT Pub. Date: Mar. 9, 2017

(65) Prior Publication Data

US 2018/0269621 A1 Sep. 20, 2018

(30) Foreign Application Priority Data

Sep. 3, 2015 (DE) ..... 10 2015 114 701.7

(51) Int. Cl.
*H01R 13/518* (2006.01)
*H01R 13/514* (2006.01)
(Continued)

(52) U.S. Cl.
CPC ..... *H01R 13/518* (2013.01); *H01R 13/506* (2013.01); *H01R 13/514* (2013.01);
(Continued)

(58) Field of Classification Search
CPC ..... H01R 43/20; H01R 43/26; H01R 13/506; H01R 13/514; H01R 13/518;
(Continued)

(56) References Cited

U.S. PATENT DOCUMENTS 3,160,280 A 12/1964 Burch
4,363,529 A * 12/1982 Loose ..... H01R 12/7058 439/82

(Continued)

FOREIGN PATENT DOCUMENTS

CN 201656162 U 11/2010
CN 202084755 U 12/2011

(Continued)

OTHER PUBLICATIONS

Machine Translation of DE 20 2013 103 611, English, Nov. 2013. (Year: 2020).*

(Continued)

*Primary Examiner* — A. Dexter Tugbang
(74) *Attorney, Agent, or Firm* — Seed IP Law Group LLP

(57) ABSTRACT

A holding frame is provided, into which plug connector modules can be inserted, wherein the holder frame comprises or consists of two halves which can be connected to each other, a first half and a second half, wherein the halves each have a lateral surface and a cover surface, wherein the holding frame has at least one first blocking element, via which the halves can be fixed in a closed position, and wherein the at least one blocking element is movably held on the first half or on the second half. The blocking element is held on the first half or on the second half in a displaceable or rotatable or pivotable manner.

11 Claims, 3 Drawing Sheets

(51) Int. Cl.

| | |
|---|---|
| ***H01R 43/26*** | (2006.01) |
| ***H01R 13/506*** | (2006.01) |
| ***H01R 13/627*** | (2006.01) |
| ***H01R 43/20*** | (2006.01) |
| *H01R 9/16* | (2006.01) |
| *H01R 13/502* | (2006.01) |

(52) U.S. Cl.
CPC ..... *H01R 13/627* (2013.01); *H01R 43/20* (2013.01); *H01R 9/16* (2013.01); *H01R 13/502* (2013.01); *H01R 43/26* (2013.01); *Y10T 29/53239* (2015.01); *Y10T 29/53252* (2015.01)

(58) Field of Classification Search
CPC ... H01R 13/502; H01R 9/16; Y10T 29/53239; Y10T 29/53252
See application file for complete search history.

(56) References Cited

U.S. PATENT DOCUMENTS

| | | | | |
|---|---|---|---|---|
| 4,693,440 | A | 9/1987 | Lalonde | |
| 5,529,426 | A | 6/1996 | Masuda et al. | |
| 5,816,836 | A | 10/1998 | Snow et al. | |
| 5,829,910 | A | 11/1998 | Kameyama | |
| 6,004,162 | A * | 12/1999 | Harting | H01R 13/518 439/532 |
| 6,196,869 | B1 | 3/2001 | Kay et al. | |
| 6,350,141 | B1 | 2/2002 | Houtz | |
| 6,692,310 | B2 | 2/2004 | Zaderej et al. | |
| 6,913,487 | B2 | 7/2005 | Beneke et al. | |
| 7,066,677 | B2 | 6/2006 | Rüter | |
| 7,753,701 | B2 | 7/2010 | Tsuji | |
| 7,896,694 | B2 | 3/2011 | Schumann et al. | |
| 8,292,676 | B2 | 10/2012 | Schmidt et al. | |
| 8,449,314 | B1 | 5/2013 | Feist et al. | |
| 8,668,530 | B2 | 3/2014 | Riepe et al. | |
| 8,770,648 | B2 | 7/2014 | Eberle et al. | |
| 8,821,186 | B2 | 9/2014 | Lan | |
| 8,979,568 | B2 | 3/2015 | Herbrechtsmeier et al. | |
| 9,502,813 | B2 | 11/2016 | Dugo | |
| 9,577,365 | B1 | 2/2017 | Herbrechtsmeier et al. | |
| 9,608,374 | B2 | 3/2017 | Beischer et al. | |
| 9,847,608 | B2 | 12/2017 | Bruex et al. | |
| 9,880,357 | B2 | 1/2018 | Drescher et al. | |
| 9,923,307 | B2 | 3/2018 | Beischer et al. | |
| 10,050,391 | B2 | 8/2018 | Herbrechtsmeier | |
| 2005/0070146 | A1* | 3/2005 | Lu | H01R 13/506 439/326 |
| 2006/0035501 | A1 | 2/2006 | Lewis et al. | |
| 2007/0155252 | A1 | 7/2007 | Ferderer | |
| 2007/0197057 | A1* | 8/2007 | Wu | H01R 13/506 439/76.1 |
| 2010/0108348 | A1* | 5/2010 | Sticker | H01R 13/506 174/67 |
| 2010/0159728 | A1 | 6/2010 | Wang et al. | |
| 2011/0111634 | A1* | 5/2011 | Ruffner | H01R 13/506 439/628 |
| 2012/0015539 | A1* | 1/2012 | Schmitt | H01R 13/502 439/312 |
| 2014/0179171 | A1 | 6/2014 | Mortun et al. | |
| 2015/0111413 | A1* | 4/2015 | Jiang | H01R 13/506 439/370 |
| 2018/0026405 | A1 | 1/2018 | Schlepp et al. | |
| 2018/0241149 | A1 | 8/2018 | Herbrechtsmeier et al. | |
| 2018/0248296 | A1 | 8/2018 | Herbrechtsmeier et al. | |
| 2018/0248297 | A1 | 8/2018 | Herbrechtsmeier et al. | |
| 2018/0248298 | A1 | 8/2018 | Schönfeld et al. | |
| 2018/0254576 | A1 | 9/2018 | Herbrechtsmeier et al. | |
| 2018/0254577 | A1 | 9/2018 | Herbrechtsmeier et al. | |
| 2018/0254578 | A1 | 9/2018 | Herbrechtsmeier et al. | |
| 2018/0277978 | A1 | 9/2018 | Schönfeld et al. | |

FOREIGN PATENT DOCUMENTS

| | | | |
|---|---|---|---|
| CN | 202352910 | U | 7/2012 |
| CN | 202772345 | U | 3/2013 |
| CN | 104064903 | A | 9/2014 |
| CN | 104466562 | A | 3/2015 |
| CN | 204205152 | U | 3/2015 |
| CN | 204271392 | U | 4/2015 |
| DE | 197 07 120 | C1 | 6/1998 |
| DE | 197 45 384 | A1 | 4/1999 |
| DE | 20 2005 020 026 | U1 | 4/2006 |
| DE | 20 2012 103 360 | U1 | 3/2013 |
| DE | 20 2013 103 611 | U1 | 11/2013 |
| DE | 10 2013 106 279 | A1 | 12/2014 |
| DE | 10 2015 101 433 | B3 | 6/2016 |
| EP | 0 843 3 84 | A2 | 5/1998 |
| EP | 2 581 991 | A2 | 4/2013 |
| FR | 2 860 348 | A1 | 4/2005 |
| GB | 1 394 867 | A | 5/1975 |
| JP | 2006067443 | A * | 3/2006 |
| RU | 2 172 048 | C2 | 8/2001 |
| RU | 71482 | U1 | 3/2008 |
| RU | 82943 | U1 | 5/2009 |
| RU | 2 526 722 | C1 | 8/2014 |
| WO | 2014/155171 | A1 | 10/2014 |

OTHER PUBLICATIONS

Guowei et al, "Research of connector model based on Knowledge Reasoning and assembly technology," Proceedings of 2011 International Conference on Computer Science and Network Technology, Harbin, 2011, pp. 10-13. (Year: 2011).*
Harting Elektronik GmbH, "Schwere Steckverbinder Han-Modular®," Product Catalog, Jan. 1999, 44 pages.
International Preliminary Report on Patentability, dated Mar. 6, 2018, for International Application PCT/DE2016/100378, 13 pages, (with English Translation).
Written Opinion of the International Search Authority, dated Nov. 28, 2016, for International Application No. PCT/DE2016/100378, 5 pages. (English Translation).
German Office Action, dated Aug. 4, 2016, for German Application No. 10 2015 114 701.7, 5 pages (No English translation provided).
International Search Report and Written Opinion, dated Nov. 28, 2016, for International Application No. PCT/DE2016/100378, 12 pages (with English translation of Search Report).
Chinese Office Action, dated Jan. 31, 2019, in Chinese Application No. 201680051241.6, 8 pages.

* cited by examiner

HOLDING FRAME COMPRISING A FIXING ELEMENT HELD IN A MOVABLE MANNER

BACKGROUND

Technical Field

The disclosure relates to a holding frame for plug connector modules. The disclosure furthermore relates to a method for equipping a holding frame with at least one plug connector module and a method for removing at least one plug connector module from a holding frame.

Holding frames of the aforementioned type serve for holding plug connector modules, wherein the holding frame is equipped with different plug connector modules and then inserted into a plug connector housing and screwed to the latter. The holding frame here has to be mechanically stable to enable it to withstand the insertion and withdrawal forces which arise during the respective joining and separation of the plug connection.

Description of the Related

A holding frame for plug connector modules is disclosed in DE 197 07 120 C1. The holding frame comprises two halves which are connected to one another via a joint. Latching hooks of the plug connector modules engage in cut-outs in the lateral surfaces of the respective halves. The joint or the end joints are arranged in the fastening ends of the holding frame. When the holding frame is screwed to a fastening surface, the frame parts are aligned such that the lateral parts of the holding frame are aligned at a right angle to the fastening surface. The plug connector modules are thus secured in the holding frame.

The holding frame in DE 197 07 120 C1 does not have a clearly defined open position for equipping the holding frame with plug connector modules. This sometimes results in a somewhat awkward assembly, in particular for inexperienced users.

To successfully equip the holding frame with plug connector modules, it has to be brought into a closed state or into a closed position so that the plug connector modules are secured. For the closed state of the holding frame of the prior art, there is no secured closed state or secured closed position, which means that the holding frame can inadvertently open, thereby enabling the modules to fall out of their anchorage.

Using a purely jointed connection, there is no defined electrical contact between the halves of the holding frame. The holding frame can therefore not be used for grounding purposes.

CN 104 466 562 A discloses a holding frame which comprises two halves which can be put together. The halves can be joined together via a linear guide and then secured to one another in a closed position with the aid of a separate securing means. CN 202 352 910 U likewise discloses a holding frame which comprises two halves which can be put together. The halves can be joined together linearly and then secured to one another in a closed position with the aid of a separate securing means. In the case of these modules, there is always the risk that the separate securing means can get lost in particular with repeated use.

DE 10 2015 101 433 B3 discloses a holding frame which comprises four individual parts, two lateral parts and two end parts. The holding frame is very stable but has to be put together in a time-consuming manner to be equipped with plug connector modules.

CN 202 084 755 U discloses a holding frame which comprises two halves connected to one another in a jointed manner. The joint can be secured in a closed position via a lock screw. However, this variant is tricky to handle since the holding frame equipped with plug connector modules has to be secured manually until the screws are tightened.

BRIEF SUMMARY

Embodiments of the present invention provide a holding frame which is easy to handle and versatile.

The holding frame according to an embodiment of the invention is provided to be equipped with at least one plug connector module. The holding frame is then generally incorporated in a plug connector housing.

The holding frame substantially comprises two halves which can be connected to one another, a first half and a second half. The halves have approximately the form of an angled profile or an angled plate and each have a lateral surface and a cover surface.

The holding frame has at least one first blocking element, whereby the halves can be secured to one another in a closed position. According to an embodiment of the invention, the blocking element is arranged at one end of the holding frame in the region of a jointed connection of the two halves. The jointed connection is explained in more detail below.

The at least one blocking element is movably held or movably mounted on the first half or on the second half in a captive manner. A locking state can be realized in a simple manner by a movable, but captively fastened, blocking element.

In an alternative embodiment of the invention, the holding frame can also have two blocking elements located at the end.

The blocking element is preferably displaceably or rotatably or pivotably held on the first half or on the second half. As a result of the movability of the blocking element, the holding frame can be easily brought from a locked state into an unlocked state.

In an advantageous embodiment of the invention, the blocking element has two protruding fingers, a first finger and a second finger. At least one latching hook is integrally formed on the end of the first finger. The first half and the second half can be latched to one another in a closed position via the latching hook(s).

The holding frame advantageously has a so-called grounding socket, which is integrally formed on the first half. The blocking element is ideally held on the grounding socket in a displaceable and in particular captive manner. The grounding socket protrudes approximately perpendicularly from a cover surface of one half of the holding frame. The blocking element could, for example, be displaceably mounted on the grounding socket on a sliding rail. The blocking element could then be displaceable in a perpendicular direction to the cover surface of the other half and engage for example in the cover surface of the other half for latching purposes.

In an advantageous embodiment of the invention, the latching hook(s) of the first finger can latch on an edge of the cover surface of the second half. The second finger can be supported on the cover surface of the second half. The holding frame can thus be secured in a closed position. The cover surface of the second half is effectively secured between the first and the second finger of the blocking element. The jointed connection of the two halves is thus blocked.

The second half preferably has a beveled unlocking edge into which a tool can engage for releasing a securing state of the closed position of the holding frame. A slotted screwdriver is a suitable tool here. With the aid of the screwdriver, the blocking element can be pried out of the latching position, whereby the jointed connection of the two halves of the holding frame is released again.

The holding frame proposed here is equipped with plug connector modules according to a particular method:

The holding frame is firstly brought or transferred into an open position.

An open position means that the halves are positioned at an angle other than 180° with respect to one another along the line of separation. It could also be said that the cover surfaces of the two halves enclose such an angle together. The angle is preferably between 130° and 170°. An angle between 155° and 165° has also proven to be particularly advantageous. In this angled position of the halves, the plug connector modules can be inserted into the holding frame particularly easily.

At least one plug connector module is then inserted into the open holding frame. However, the holding frame is generally filled with a plurality of plug connector modules depending on the number of receiving spaces.

When the plug connector modules are inserted, the holding frame is brought or transferred into a closed position. In the closed position, the halves or the cover surfaces thereof assume an angle of approximately 180° or precisely 180° with respect to one another. The halves are therefore parallel to one another in the closed position.

The holding frame is finally locked in the closed position with the aid of a blocking element fastened to the holding frame in a captive manner.

The method proposed here for equipping a holding frame with plug connector modules is advantageously carried out with embodiments of the holding frame disclosed herein.

The removal of at least one plug connector module from a holding frame proceeds as follows:

a tool firstly engages in an unlocking edge of the holding frame. The tool is generally a slotted screwdriver, which virtually any technician has;

the unlocking of the holding frame then takes place by the tool being inserted into the unlocking edge, for example by prying out a latched blocking element described above;

the holding frame is subsequently transferred into an open position; and at least one plug connector module is finally removed from the open holding frame. All plug connector modules are generally removed and can be replaced by new plug connector modules as described above.

The removal, described here, of plug connector modules from a holding frame also functions ideally with embodiments of the holding frame disclosed herein.

BRIEF DESCRIPTION OF THE SEVERAL VIEWS OF THE DRAWINGS

An exemplary embodiment of the invention is illustrated in the drawings and will be explained in more detail below. In the drawings.

The figures contain partially simplified schematic illustrations. Identical reference numerals are sometimes used for elements which are similar but possibly not identical. Different views of similar elements can be drawn to different scales.

DETAILED DESCRIPTION

Figure 1:
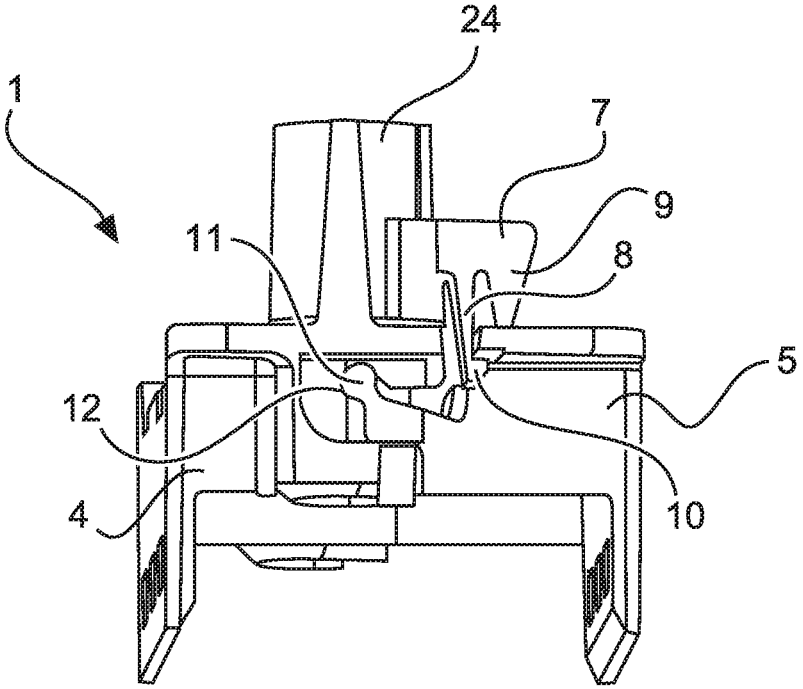
FIG. 1 shows a perspective illustration of a holding frame in a closed and latched position.

FIG. 1 shows the perspective illustration of a holding frame 1 which is in a closed position. The holding frame 1 substantially comprises two halves 4, 5, which are connected to one another via a joint. To this end, one half 5 has a joint head 11 on the respective end faces, which joint head 11 engages in a joint receiving means 12 (e.g., joint receiving cavity) provided for this purpose in the opposite half 4. This is referred to as a jointed connection of the two halves 4, 5 of the holding frame 1.

The respective halves 4, 5 have a lateral surface 2, 2' and a cover surface 3, 3'. In the closed position of the holding frame 1, the cover surfaces 3, 3' are at an angle of 180° with respect to one another. The cover surfaces 3, 3' are then located in a plane.

The holding frame 1 has a grounding socket 24, in which a pin (not shown) of an opposite holding frame (not shown) can engage. A rail 13 is integrally formed on the grounding socket 24. The blocking element 7 has a receiving means, by way of which the blocking element 7 is held on the rail 13 in a displaceable and captive manner. The rail 13 is designed to be approximately trapezoidal. The receiving means of the blocking element 7 is correspondingly designed to match said rail. The blocking element 7 can be displaced along the rail 13 in the direction of the cover surface 3.

The blocking element 7 has two fingers 8, 9 which are aligned in the direction of the cover surface 3. The first finger 8 is designed to be longer than the second finger 9. The first finger 8 has a latching hook 10 at the end.

Figure 4:
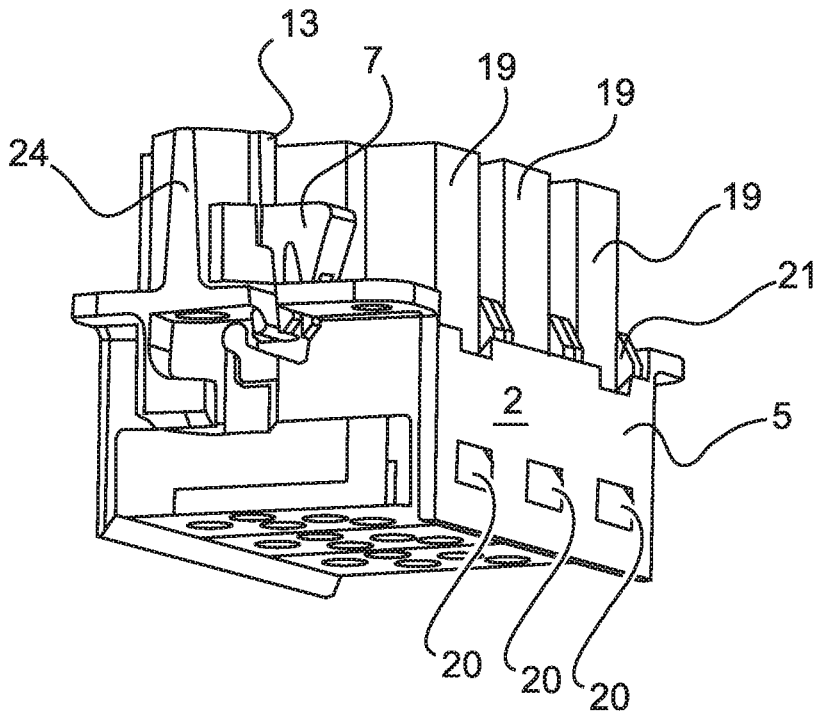
FIG. 4 shows a perspective illustration of a holding frame in a closed and latched position with integrated plug connector modules.

In the closed position of the holding frame 1 (FIGS. 1 and 4), the latching hook 10 of the first finger 8 latches on or behind an edge of the cover surface 3 of the second half 5. At the same time, the second finger 9 of the blocking element 7 is supported on the cover surface 3 of the second half 5. The second half 5 can therefore no longer be moved relative to the first half 4. The holding frame 1 can thus be secured in a closed position.

To enable the closed position to be unlocked again, an unlocking edge 6 extending downwards at an angle has been integrally formed in the cover surface 3 of the second half 5. A slotted screwdriver can engage here for example and pry the blocking element 7 out of the latching state. The jointed connection of the holding frame 1 is then released again. The holding frame 1 can be opened, the plug connector modules 19 removed or new plug connector modules 19 incorporated.

Figure 5:
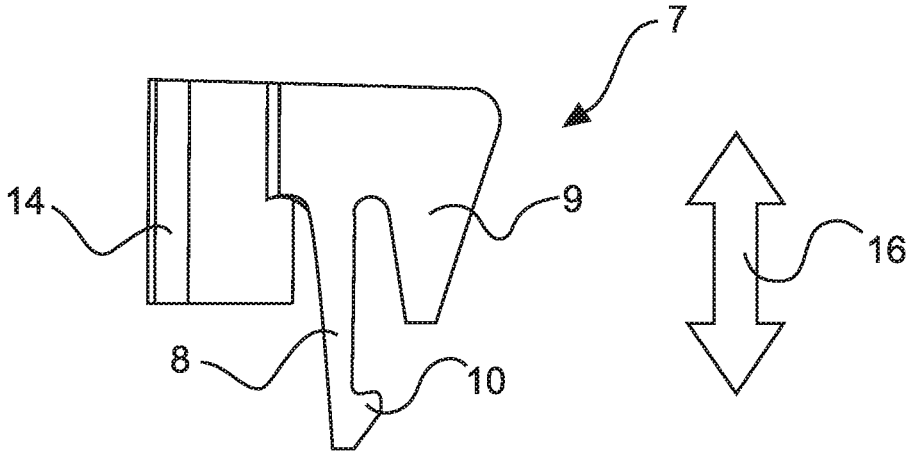
FIG. 5 shows a side view of a blocking element.
Figure 6:
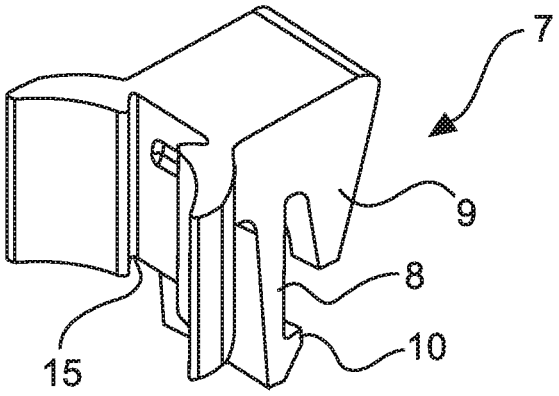
FIG. 6 shows a perspective view of the blocking element.
Figure 7:
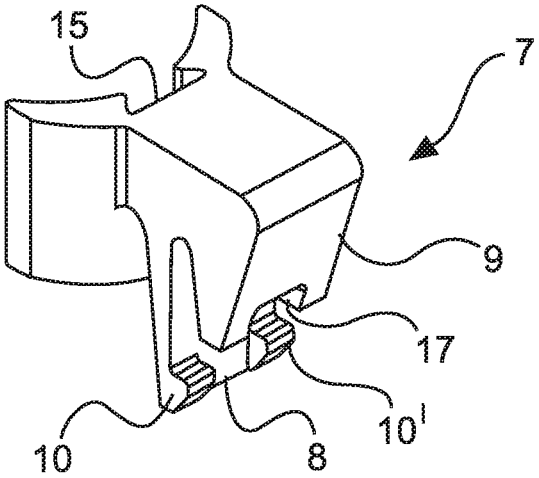
FIG. 7 shows a further perspective view of the blocking element.

The blocking element is shown in various different illustrations in FIGS. 5 to 7. The blocking element 7 has a semi-cylindrical holding region 14 which at least partially comprises the grounding socket 24 of the first half 4. A trapezoidal groove 15 is integrally formed in the holding region 14, which groove 15 is designed to precisely match the rail 13 integrally formed on the grounding socket 24. The system of groove 15 and rail 13 enables a sliding movement of the blocking element 7 in the direction of the double-headed arrow 16.

The blocking element 7 has an inner first finger 8 which is provided with a latching hook 10 at the end. The latching hook 10 acts on the cover surface 3 of the second half 5 when the holding frame 1 is in a closed position. The outer, second finger 9 of the blocking element 7 is designed to be somewhat shorter than the first finger 8 and—in the closed position of the holding frame 1—is supported on the cover surface 3 of the second half 5. The fingers 8 and 9 are aligned substantially perpendicularly to the cover surface 3 of the second half 5. The cover surface 3 is thus clamped between the fingers 8 and 9 and thus blocked. The holding frame 1 is secured in the closed position.

A recess 17 is incorporated in the end region of the second finger 9. A tool can engage in this recess 17 and, interacting with the unlocking edge 6 integrally formed in the second half 5, can pry the blocking element 7 out of the latching position, whereby the jointed connection of the holding frame 1 is released again and the holding frame 1 can be transferred back into an open position.

Plug connector modules 19 have been known for a long time and are described for example in DE 197 07 120 C1. The plug connector modules 19 are provided with protruding, approximately rectangular holding means 20 and resilient latching hooks 21. Cut-outs or recesses 23 which are formed as fully enclosed openings and into which the holding means 20 of the plug connector modules 19 extend when the plug connector modules 19 are inserted in the holding frame 1, are provided in the lateral parts 2, 2' of the halves 4, 5.

Figure 2:
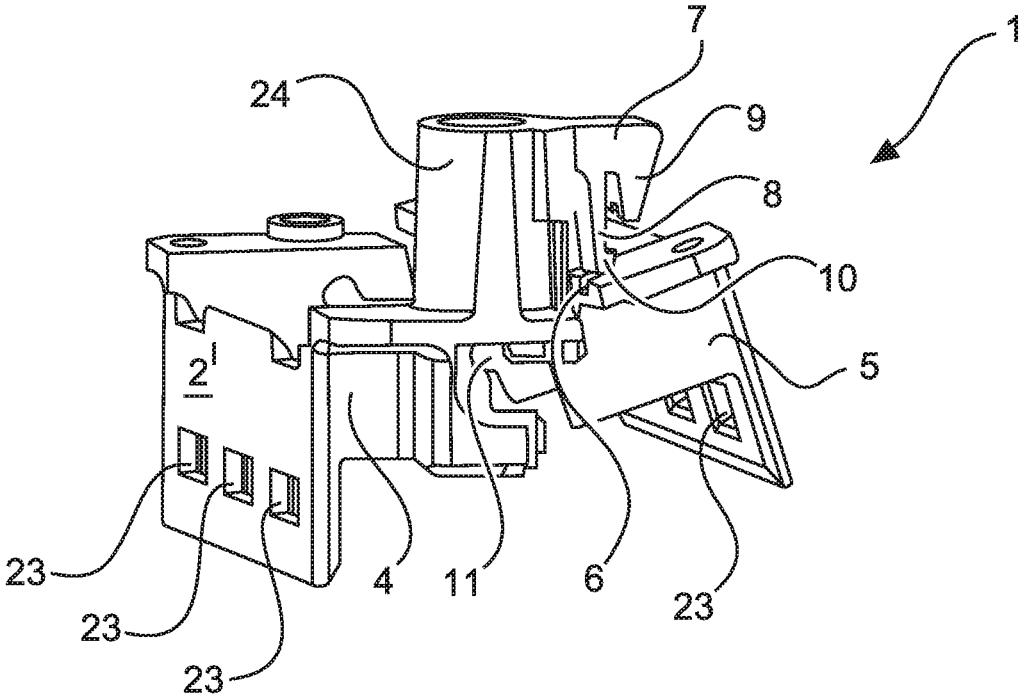
FIG. 2 shows a perspective illustration of a holding frame in an open position.
Figure 3:
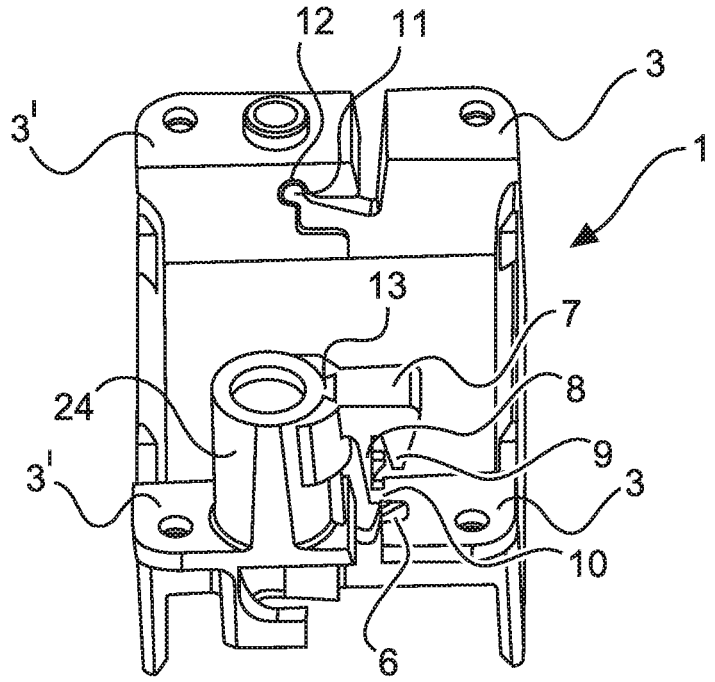
FIG. 3 shows a perspective illustration of a holding frame in a closed and unlatched position.

To insert the plug connector modules 19, the holding frame 1 is opened as can be seen in FIG. 2 so that the plug connector modules 19 can be inserted. To pre-secure the plug connector modules 19, the latching hooks 21 firstly reach below the lower edges of the lateral parts 22 of the halves 4, 5 during insertion.

The frame halves 4, 5 are then brought into a closed position as can be seen in FIG. 1, wherein the holding means 20 of the plug connector modules 19 arrive in the cut-outs or recesses 23 and a reliable form-fitting holding of the plug connector modules 19 in the holding frame 1 is effected.

According to one embodiment, the blocking element 7 advantageously consists of an electrically conductive material. The same generally applies to the two halves 4, 5 of the holding frame 1. The halves 4, 5 can be reliably connected to one another, or in contact with one another, in an electrically conductive manner via the blocking element 7 so that the holding frame 1 can also be used for grounding purposes.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame into which plug connector modules having outwardly projecting lugs are insertable, the holding frame comprising:

two frame halves, namely, a first frame half and a second frame half, which are connected to one another and configured to pivot relative to each other between a closed position and an open position, and which each include openings to receive the outwardly projecting lugs of the plug connector modules when the plug connector modules are loaded in the holding frame in the open position and the frame halves are thereafter moved from the open position to the closed position; and at least one blocking element that is separate and distinct from the two frame halves of the holding frame, and wherein the blocking element is attached directly to one of the two frame halves of the holding frame at a movable joint that enables the blocking element to move relative to the one of the two frame halves between a blocking position and an unblocking position, and whereby the two frame halves are secured in the closed position by the at least one blocking element when the at least one blocking element is moved into the blocking position to physically contact the other one of the two frame halves and physically block the first frame half and the second frame half from pivoting to the open position.

2. The holding frame as claimed in claim 1, wherein the at least one blocking element is displaceably or rotatably or pivotably held on the first frame half or on the second frame half.

3. The holding frame as claimed in claim 1, wherein:

the blocking element has two protruding fingers, namely, a first finger and a second finger, and at least one latching hook is integrally formed on an end of the first finger.

4. The holding frame as claimed in claim 3, wherein:

the latching hook of the first finger can latch on or behind an edge of a cover surface of the second frame half, the second finger can be supported on the cover surface of the second frame half, and the holding frame can thus be secured in the closed position.

5. The holding frame as claimed in claim 4, wherein the second frame half has a beveled unlocking edge into which a tool can engage for releasing a securing state of the closed position of the holding frame.

6. The holding frame as claimed in claim 1, wherein the holding frame has a grounding socket which is integrally formed on the first frame half.

7. The holding frame as claimed in claim 6, wherein the blocking element is displaceably held on the grounding socket.

8. The holding frame of claim 1, wherein, when the two frame halves are in the closed position, the openings assist in holding the plug connector modules in place within the holding frame via interaction with the projections on sides of the plug connector modules.

9. The holding frame of claim 1, wherein the other one of the two frame halves includes a cover surface that is perpendicular to a plug-in direction of the holding frame when the two frame halves are in the closed position, and wherein the blocking element engages the cover surface when the blocking element is in the blocking position to physically obstruct the first frame half and the second frame half from pivoting to the open position.

10. A method for equipping a holding frame with plug connector modules having outwardly projecting lugs, the holding frame comprising two frame halves which are connected to one another and configured to pivot relative to each other between a closed position and an open position, and which include openings to receive the outwardly projecting lugs of the plug connector modules when the plug connector modules are loaded in the holding frame in the open position and the two frame halves are thereafter moved from the open position to the closed position, and the holding frame comprising at least one blocking element which is movably coupled to the two frame halves, the method comprising:

transferring the holding frame into the open position;

inserting at least one plug connector module into the holding frame in the open position;

transferring the holding frame into the closed position such that the outwardly projecting lugs of the at least one plug connector module are received in the openings of the two frame halves; and locking the holding frame in the closed position with the aid of the at least one blocking element which is separate and distinct from the two frame halves of the holding frame and which is attached directly to one of the two frame halves of the holding frame at a movable joint that enables the blocking element to move relative to the one of the two frame halves between a blocking position and an unblocking position, the locking of the holding frame occurring by moving the at least one blocking element into the blocking position to physically contact the other one of the two frame halves and physically block the two frame halves from pivoting to the open position.

11. A method for removing at least one plug connector module having outwardly projecting lugs from a holding frame, the holding frame comprising two frame halves which are connected to one another and configured to pivot relative to each other between a closed position and an open position, and which include openings to receive the outwardly projecting lugs of the plug connector module when the plug connector module is loaded in the holding frame in the open position and the two frame halves are thereafter moved from the open position to the closed position, and the holding frame comprising at least one blocking element which is separate and distinct from the two frame halves of the holding frame and which is attached directly to one of the two frame halves at a movable joint that enables the blocking element to move relative to the one of the two frame halves from an unblocking position to a blocking position to secure the two frame halves in the closed position in a locking state by physically contacting the other one of the two frame halves and physically blocking the two frame halves from pivoting to the open position, the method comprising:

engaging a tool in an unlocking edge of the holding frame;

releasing the locking state of the holding frame by prying the at least one blocking element attached directly to the one of the two frame halves of the holding frame out of the blocking position;

transferring the holding frame into the open position; and removing the at least one plug connector module from the holding frame in the open position, wherein transferring the holding frame into the open position and removing the at least one plug connector module includes withdrawing the outwardly projecting lugs of the plug connector module from the openings of the frame halves.

* * * * *